US006892623B2

(12) United States Patent
Benyami et al.

(10) Patent No.: US 6,892,623 B2
(45) Date of Patent: May 17, 2005

(54) BALLISTIC ARMOR PANEL

(75) Inventors: Moshe Benyami, Haifa (IL); Yehiel Reifen, Kiryat Hayim (IL); Siegfried Wenkert, Haifa (IL)

(73) Assignee: The State of Israel, Ministry of Defense, Armament Development Authority, Rafael (IL)

( * ) Notice: Subject to any disclaimer, the term of this patent is extended or adjusted under 35 U.S.C. 154(b) by 0 days.

(21) Appl. No.: 09/785,072

(22) Filed: Feb. 16, 2001

(65) Prior Publication Data

US 2001/0032541 A1 Oct. 25, 2001

(30) Foreign Application Priority Data

Feb. 21, 2000 (IL) ..... 134642

(51) Int. Cl.[7] ..... F41H 5/02
(52) U.S. Cl. ..... 89/36.02; 89/36.04
(58) Field of Search ..... 89/36.02; 428/116, 428/117

(56) References Cited

U.S. PATENT DOCUMENTS

| | | | | | |
|---|---|---|---|---|---|
| 3,634,117 | A | * | 1/1972 | Glaser | 428/412 |
| 4,198,454 | A | * | 4/1980 | Norton | 428/117 |
| 4,307,140 | A | | 12/1981 | Davis | 428/86 |
| 4,529,640 | A | * | 7/1985 | Brown et al. | 428/116 |
| 4,841,838 | A | * | 6/1989 | Scully et al. | |
| 5,014,593 | A | * | 5/1991 | Auyer et al. | |
| 5,221,807 | A | * | 6/1993 | Vives | |
| 5,349,893 | A | * | 9/1994 | Dunn | |
| H1434 | H | * | 5/1995 | Cytron | |
| 5,456,156 | A | * | 10/1995 | Semple | |
| 5,972,819 | A | | 10/1999 | Cohen | 501/127 |
| 6,203,908 | B1 | * | 3/2001 | Cohen | |
| 6,289,781 | B1 | * | 9/2001 | Cohen | |

FOREIGN PATENT DOCUMENTS

| | | | | |
|---|---|---|---|---|
| EP | 0 151 011 | | 8/1985 | |
| FR | 2 526 535 | | 11/1983 | F41H/5/02 |
| GB | 0127321 | * | 6/1919 | |
| WO | WO 91/07632 | | 5/1991 | F41H/5/04 |
| WO | WO 98/37376 | | 8/1998 | F41H/5/04 |

OTHER PUBLICATIONS

H1434, US SIR, Cytron, May 2, 1995.*

* cited by examiner

*Primary Examiner*—Michael J. Carone
*Assistant Examiner*—Troy Chambers
(74) *Attorney, Agent, or Firm*—Fitch, Even, Tabin & Flannery

(57) ABSTRACT

A ballistic armor panel for attaching to an object, the panel comprising a carrying board made of a hard material and formed with a plurality of adjoining through-going apertures, each aperture receiving a body made of a hard material and having a longitudinal axis coaxial with an axis of the respective aperture.

13 Claims, 3 Drawing Sheets

BALLISTIC ARMOR PANEL

FIELD OF THE INVENTION

This invention generally relates to ballistic armor panels of the type useful in protection of objects and equipment against small arms bullets and kinetic energy projectiles, i.e. fire arm rounds and projectiles artillery fragments and shrapnel. The invention is in particular concerned with a carrying board supporting a plurality of bodies.

BACKGROUND OF THE INVENTION

Ballistic armor panels are utilized for a variety of protective missions, in particular for reducing hit-risk of objects such as vehicles, equipment, structures, etc. from small arms projectiles, kinetic energy penetrators and from fragments of explosive charges, bombs, etc. For that purpose, armor panels are applied to the objects, which armor panels should be capable of stopping a bullet or a projectile or a fragment of an explosive charge within an extremely short distance, i.e. the effective thickness of the ballistic armor panel.

A variety of armor panels are known, each typically comprising several layers of material holding a plurality of hard bodies typically made of ceramic material for effectively distributing the impact of a projectile, bullet, etc. Typically the ceramic bodies are bonded to the carrying layers by suitable adhesive materials.

One considerable disadvantage of heretofore known armor panels resides in that the carrying layers are not fitted for attaching directly to the object to be protected, whereby additional fixing means are required which are both heavy and somewhat cumbersome in assembly. A second disadvantage is the labor required for assembling protective panels of the aforementioned type. Evermore, the ceramic bodies are exposed and are thus vulnerable to mechanical damage and after a series of several hits they may brake and the ballistic panel may loose its effectiveness. In particular, the edges of the ceramic bodies are susceptible to damage and break easily, reducing the effectiveness of the armor panel.

It is thus an object of the present invention to provide a new and improved armor panel, which substantially reduces or overcomes the above drawbacks.

SUMMARY OF THE INVENTION

The present invention provides an improved ballistic armor panel for attaching to an object, the panel comprising a carrying board made of a hard material and formed with a plurality of adjoining through-going apertures, each aperture receiving a body made of a hard material and having a longitudinal axis coaxial with an axis of the respective aperture. Typically, the bodies are made of a ceramic material, such as, for example, alumina silicone carbide, boron carbide, etc. The bodies may be made of a low density material although this is not a requirement.

Preferably, the bodies correspond in shape with the apertures of the board. Said bodies may be cylindrical or polygonal. By one specific design, where the bodies are polygonal, the openings of the carrying board form together a honeycomb like shape.

Preferably, in order to retain the bodies within the apertures and to reduce their susceptibility to breakage, the apertures are formed with an annular rim extending into the aperture and being essentially flush with a surface of the carrying board remote from the object.

According to a different embodiment, the apertures taper from a face of the carrying board facing the object.

The bodies may be also adhered within the apertures of the carrying board. They may also be adhered to a back layer of resilient material applied between the object and the carrying board. Such a layer may be made, for example, from laminates of ballistic fibers.

The carrying board may be formed with suitable bores for directly attaching to a surface of the object. Any of the apertures of the board may serve as a bore.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF PREFERRED EMBODIMENTS

Figure 1:
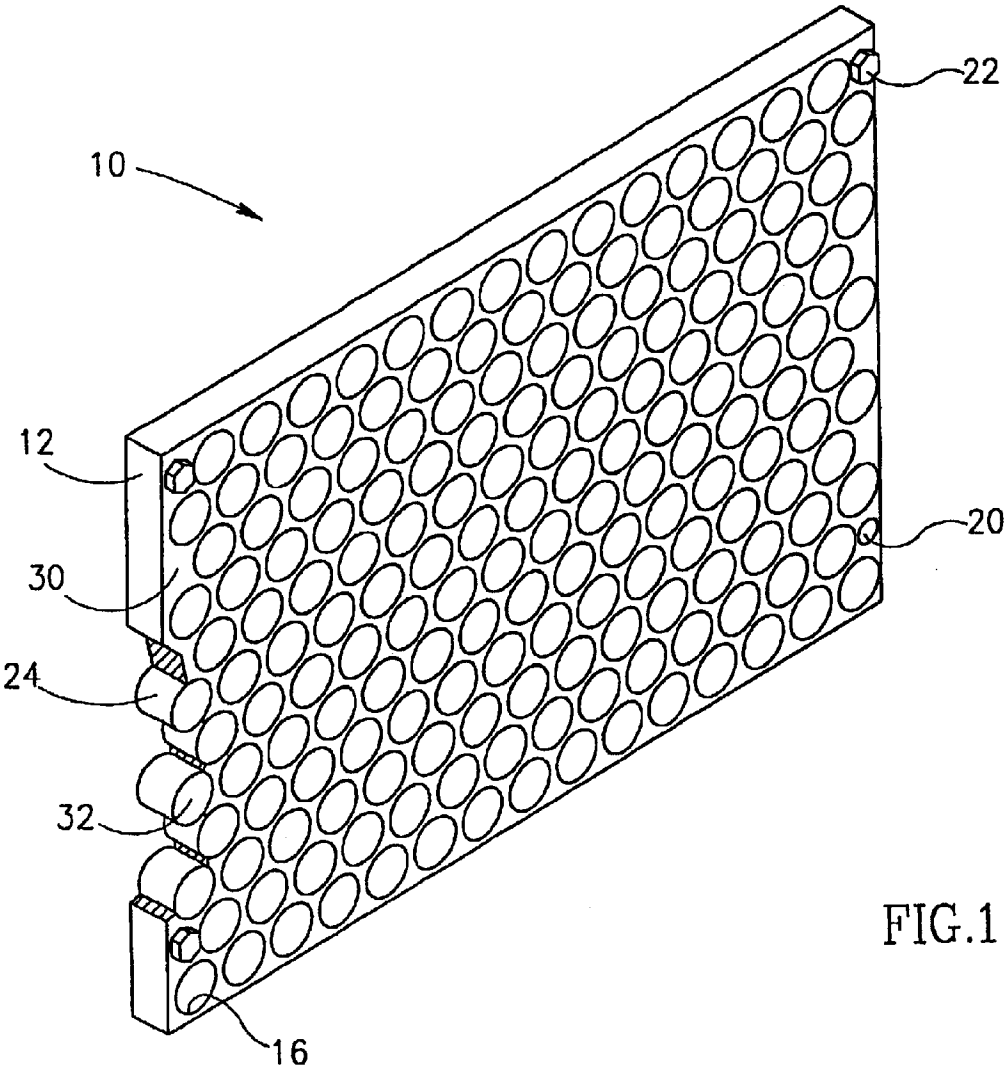
FIG. 1 is perspective view, partially cut-out, of a ballistic armor panel according to a first embodiment of the present invention.

Attention is first directed to FIG. 1 of the drawings in which a ballistic panel 10 comprising a carrying board 12 made of a hard material such as, for example, steel, titanium, aluminum, composite materials, etc. The carrying board is formed with a plurality of apertures 16, which in the present example are cylindrical. The apertures 16 may be machined or may be pre-molded, e.g. when the carrying board is made of cast material.

The thickness of the wall between adjoining apertures is between about 0.5 to 1 mm. However, this thickness may differ depending on different parameters such as type of materials and its mechanical properties, thickens of panel, etc.

The carrying board 12 is formed with several bores 20, for connecting the panel to an object by bolts 22, etc. However, any one of the apertures 16 may also serve for attaching the board to the object (not shown). The object may be a structure, a vehicle, etc. and the board may be attached with possible use of different adapters.

A plurality of cylindrical bodies 24, made of an essentially hard material e.g. hard ceramics such as alumna, boron carbide, silicone carbide, glass, etc. are received within the apertures 16. The bodies 24 are snugly received within the apertures 16 and their axial length does not exceed that of the apertures, whereby the bodies 24 do not project from a front face 30 of the carrying board 12.

In order to prevent the bodies 24 from spontaneously detaching from the carrying board 12, a bonding material may be applied between the walls of the bodies 24 and the apertures 16.

According to one particular embodiment (not shown), the axial length of the bodies 24 is shorter than that of the apertures and the front faces 32 of the bodies are retracted so that they extend below the front face 30 of the carrying board, rendering the edges of the bodies less susceptible to external impact and to deterioration upon hitting by an external body thus reducing the damage of the bodies 24.

Figure 2:
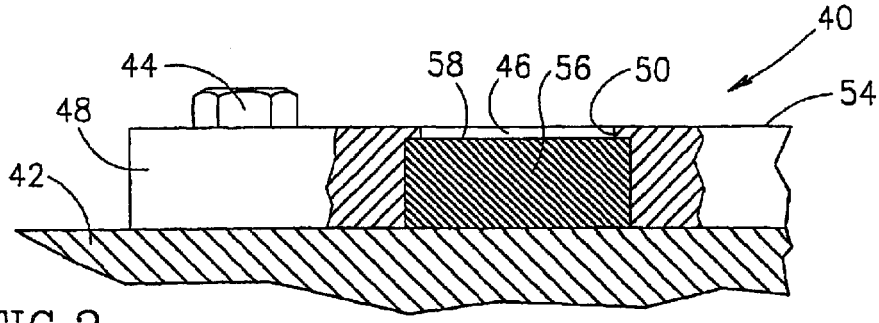
FIG. 2 is a sectional view of a portion of a ballistic panel according to a modification of the invention, wherein the apertures are formed with an annular rim.

Further attention is now directed to FIG. 2, wherein an armor panel 40 is attached to an object 42 by bolts 44. The apertures 46 of the carrying member 48 are formed with an annular rim 50 at a front end thereof, essentially flush with the front face 54 of the panel. This arrangement is useful both for retaining the bodies 56 within the apertures 46 as well as for preventing deterioration of the edges of the front face 58 of the body 56.

Figure 3:
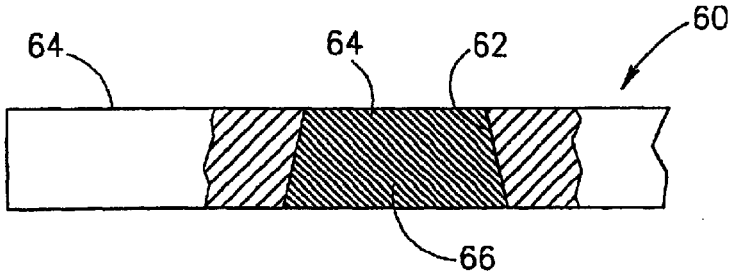
FIG. 3 is a sectional view of a portion of a ballistic panel according to a still a modification of the invention, wherein the apertures taper.

In FIG. 3 the carrying board 60 is formed with a plurality of apertures 62 tapering from a wide opening at a rear face facing the object (not shown) and a narrower opening at the front face 64. This arrangement ensures that the bodies 66 do not disengage from the apertures of the carrying board.

Figure 4:
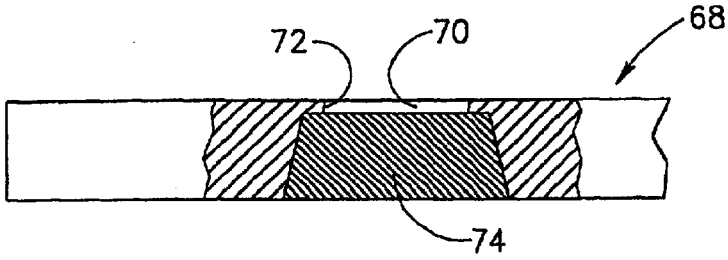
FIG. 4 is a sectional view illustrating a modification of the embodiment seen in FIG. 3 wherein the apertures taper and are formed with an annular rim.

In the embodiment of FIG. 4 the carrying board 68 comprises tapering apertures to in the embodiment of FIG. 3 with the addition that each aperture is formed with an annular rim 72 as in the embodiment of FIG. 2, whereby the bodies 74 supported in such apertures are shorter than those of FIG. 3 and are thus more protected.

Figure 5:
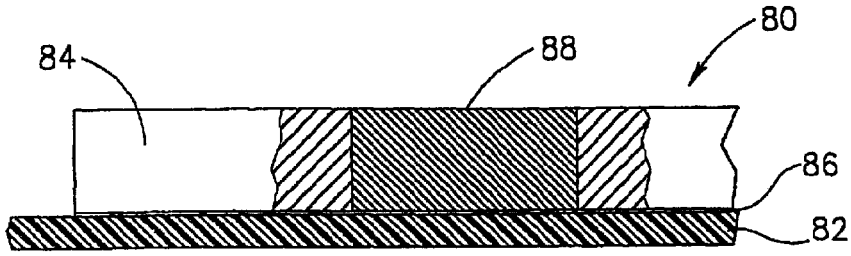
FIG. 5 is a sectional view illustrating a further application of the present invention, with a resilient back-layer provided at a back face of the carrier board.

FIG. 5 represents still a further embodiment in which a ballistic panel 80, which is similar to the embodiment of FIG. 1, (although any other of the previous embodiments may be selected). In the present embodiment there is provided a thin layer of flexible material 82 (such as a resilient material, Kevlar™, Dyneema™, fiberglass, laminate of ballistic fibers, etc.) adhered to the back face of the carrying board 84 by a layer of adhesive substance 86, bonding the bodies 88 on the one hand, and providing some impact dampening on the other hand.

Figure 6:
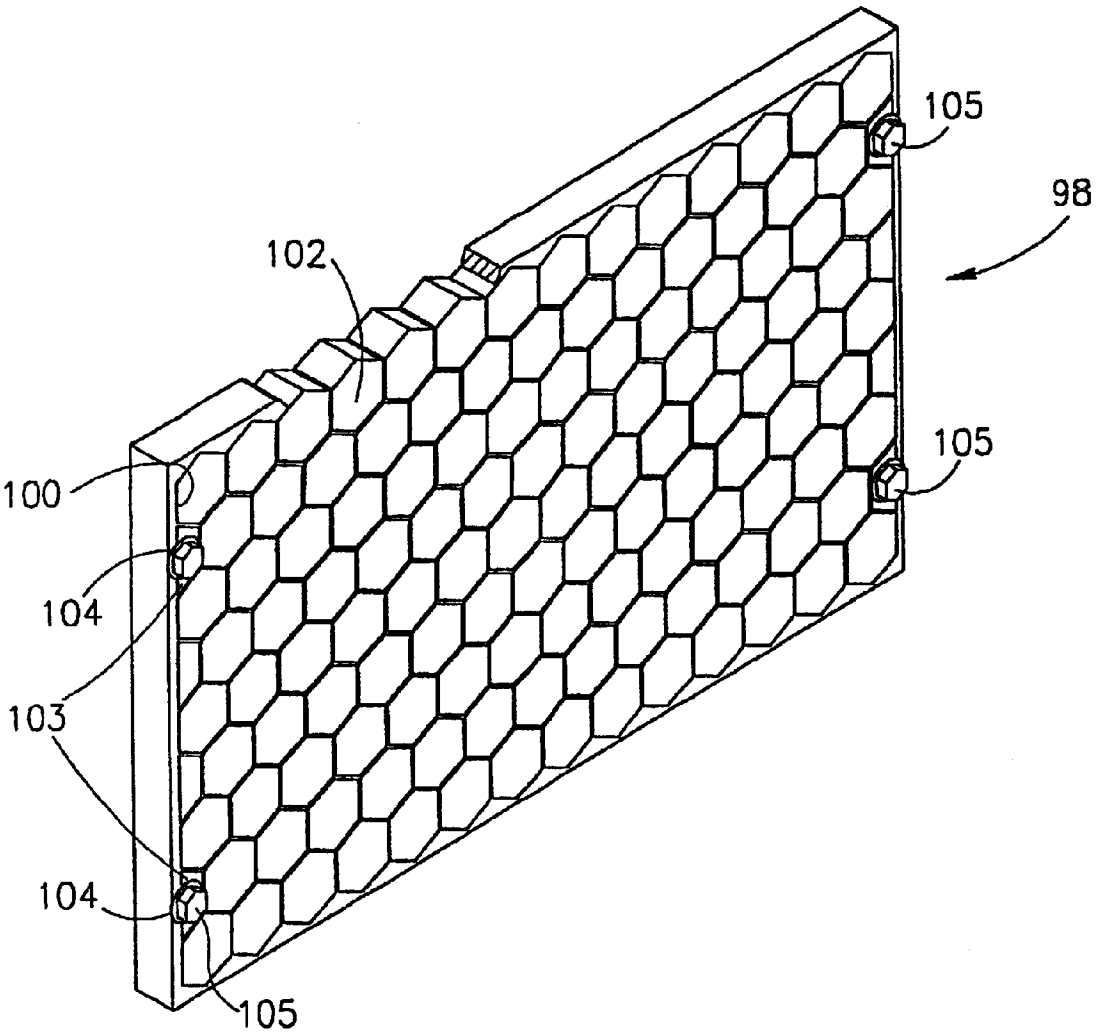
FIG. 6 is a perspective view, partially cut-out, of still a different embodiment of the invention.

In FIG. 6 there is shown a ballistic panel 98 formed with a plurality of polygonal apertures 100 (hexagonal in the specific embodiment, though any other polygonal shape will be suitable, e.g., triangular, square, hectagonal etc.) each fitted with a body 102 having a corresponding shape and retained as explained hereinbefore. Bolts 105 extend via edge apertures 103 and are fitted with washers 104.

As will be appreciated by a versed person, only some preferred embodiments have been shown and described in the specification and drawings. However, it is to be understood that it is not intended thereby to limit the disclosure of the invention, but rather it is intended to cover all modifications and arrangements falling within the scope and the spirit of the present invention, *mutatis mutandis*.

What is claimed is:

1. A ballistic armor panel for attaching to an object to protect it against small arms bullets and kinetic energy projectiles, the panel comprising a carrying board, said board being made of hard material, said board being a single part having a peripheral portion and a receiving portion, said peripheral portion being integral with the receiving portion, wherein said receiving portion is provided with a meshed structure defined by a plurality of adjoining through-going apertures having a polygonal cross-section, said apertures are distributed within the board in such a manner that the wall thickness between adjoining apertures is kept at a minimum, each aperture accommodating therein a body made of a hard material, said body having a longitudinal axis which is coaxial with an axis of the respective aperture and said body having a polygonal cross-section corresponding to the polygonal cross-section of the respective aperture along the said longitudinal axis.

2. A ballistic armor panel according to claim 1, wherein walls of the apertures taper from a face thereof facing the object.

3. A ballistic armor panel according to claim 1, wherein the bodies are fixed to the carrying board by an adhesive substance.

4. A ballistic armor panel according to claim 1, wherein the bodies are defined by an axial length and the board is defined by a thickness, wherein the axial length of said bodies does not exceed the thickness of the board.

5. A ballistic armor panel according to claim 1, wherein a layer of resilient material is provided intermediate the object and the carrying board.

6. A ballistic armor panel for attaching to an object, the panel comprising a carrying board, said board being made of hard material, said board having a peripheral portion and a receiving portion, said peripheral portion being integral with the receiving portion, wherein said receiving portion is provided with a structure defined by a plurality of adjoining through-going apertures having a polygonal cross-section, each aperture accommodating therein a body made of a hard material, said body having a polygonal cross-section matching the polygonal section of the respective aperture and said body having a longitudinal axis coaxial with an axis of the respective aperture, wherein wall thickness between adjoining apertures is between about 0.5 mm to 1 mm.

7. A ballistic armor panel as in claim 1, in which the hard material of the body is a ceramic material.

8. A ballistic armor panel as in claim 1, in which the hard material of the body is silicone carbide.

9. A ballistic armor panel for attaching to an object, the panel comprising:

a carrying board made of a hard metal or a composite material formed with a plurality of adjoining through-going polygonal apertures having annular rims being flush with a face of the carrying board remote from the object; and a plurality of bodies made of hard material and having polygonal shape corresponding to the shape of the apertures, wherein each polygonal aperture accommodating a body of the plurality of bodies with a longitudinal axis of each body being coaxial with an axis of the respective aperture, and wherein adjoining sides of the bodies accommodated in adjoining apertures are parallel to each other and separated by aperture wall having thickness of about 0.5 mm to 1 mm.

10. A ballistic armor panel for attaching to an object, the panel comprising:

a carrying board made of a hard metal or a composite material formed with a plurality of adjoining through-going polygonal apertures having annular rims being flush with a face of the carrying board remote from the object; and a plurality of bodies made of hard material and having a polygonal shape corresponding to the shape of the apertures, wherein each polygonal aperture accommodating a body of the plurality of bodies with a longitudinal axis of each body being coaxial with an axis of the respective aperture.

11. A ballistic armor panel for attaching to an object, the panel comprising:

a carrying board made of a hard material formed with a plurality of adjoining through-going polygonal apertures and having bores for attaching to the object; and a plurality of bodies made of hard material and having a polygonal shape corresponding to the shape of the apertures, wherein each polygonal aperture accommodating a body of the plurality of bodies with a longitudinal axis of each body being coaxial with an axis of the respective aperture.

12. A ballistic armor panel for attaching to an object, the panel comprising:

a carrying board made of a hard material formed with a plurality of adjoining through-going polygonal apertures and attached to the object by fasteners extending through the apertures; and a plurality of bodies made of hard material and having a polygonal shape corresponding to the shape of the apertures, wherein each polygonal aperture accommodating a body of the plurality of bodies with a longitudinal axis of each body being coaxial with an axis of the respective aperture.

13. A ballistic armor panel for attaching to an object, the panel comprising:

a carrying board made of a hard material formed with a plurality of adjoining through-going polygonal apertures and having bores for attaching to the object; and a plurality of bodies made of hard material and having a polygonal shape corresponding to the shape of the apertures, wherein each polygonal aperture accommodating a body of the plurality of bodies with a longitudinal axis of each body being coaxial with an axis of the respective aperture, and adjoining sides of the bodies accommodated in adjoining apertures are parallel to each other and separated by aperture wall having thickness of about 0.5 mm to 1 mm.

* * * * *

UNITED STATES PATENT AND TRADEMARK OFFICE

CERTIFICATE OF CORRECTION

PATENT NO. : 6,892,623 B2
DATED : May 17, 2005
INVENTOR(S) : Benyami et al.

It is certified that error appears in the above-identified patent and that said Letters Patent is hereby corrected as shown below:

Column 6,
After line 16, add claims:

14. A ballistic armor panel as in Claim 1, in which the hard material of the board is steel.

15. A ballistic armor panel as in Claim 1, in which the hard material of the board is titanium.

16. A ballistic armor panel as in Claim 1, in which the hard material of the board is a ceramic composition.

Signed and Sealed this

Seventh Day of February, 2006

JON W. DUDAS
*Director of the United States Patent and Trademark Office*

UNITED STATES PATENT AND TRADEMARK OFFICE

CERTIFICATE OF CORRECTION

PATENT NO. : 6,892,623 B2
APPLICATION NO. : 09/785072
DATED : May 17, 2005
INVENTOR(S) : Benyami et al.

It is certified that error appears in the above-identified patent and that said Letters Patent is hereby corrected as shown below:

*Title Page*: item

(73) Assignee:

Delete "The State of Israel, Ministry of Defense, Armament Development Authority, Rafael (IL)", and insert -- Rafael Armament Development Authority Ltd., Haifa, (IL) --.

Signed and Sealed this

Twenty-fourth Day of July, 2007

JON W. DUDAS
*Director of the United States Patent and Trademark Office*